United States Patent [19]

Crispin et al.

[11] Patent Number: 5,060,124

[45] Date of Patent: Oct. 22, 1991

[54] CONCEALABLE BIRTHING ROOM LIGHT

[75] Inventors: George E. Crispin, La Canada; Burnie M. Craig, South Laguna; Roy K. Fujitaki, Altadena, all of Calif.

[73] Assignee: ALM Surgical Equipment, Inc., Santa Ana, Calif.

[21] Appl. No.: 590,307

[22] Filed: Sep. 28, 1990

[51] Int. Cl.[5] ..... F21S 1/14

[52] U.S. Cl. ..... 362/147; 362/272; 362/286; 362/386; 362/404; 362/804

[58] Field of Search ..... 362/148, 147, 269, 271, 362/272, 285, 286, 386, 404, 801, 804, 365; 248/324

[56] References Cited

U.S. PATENT DOCUMENTS

| | | | |
|---|---|---|---|
| 1,930,081 | 10/1933 | Biller | 362/129 |
| 1,938,237 | 12/1933 | Wagenhorst | 362/147 |
| 2,124,050 | 7/1938 | Bruner | 362/63 |
| 2,528,935 | 11/1950 | Williams | 312/30 X |
| 2,859,331 | 11/1958 | Grimes | 362/63 |
| 2,905,518 | 9/1959 | Doesken | 312/319 |
| 3,010,013 | 11/1961 | Gunther et al. | 362/147 |
| 3,702,928 | 11/1972 | Alger | 362/33 |
| 4,233,652 | 11/1980 | Oswald | 362/63 |
| 4,234,908 | 11/1980 | McGee | 362/66 |
| 4,274,686 | 6/1981 | White | 312/27 |
| 4,454,569 | 6/1984 | Maguire | 362/127 |
| 4,511,954 | 4/1985 | Marcus et al. | 362/275 |
| 4,651,258 | 3/1987 | Davis et al. | 362/147 |
| 4,802,065 | 1/1989 | Minter et al. | 362/147 X |

*Primary Examiner*—Stephen F. Husar

*Attorney, Agent, or Firm*—Christie, Parker & Hale

[57] ABSTRACT

A concealable surgical light device such as for a birthing room has a frame for supporting the light on one side and a decorative panel on the other side. The frame includes reinforcing ribs positioned in a Y shape, and a cylindrical section at the intersection of the ribs for attaching the light. The frame is rotatably supported inside a housing which is fixed within the ceiling structure. At one end of the housing there is a fixed tube and a bearing and at the other end is an output shaft of a speed reducer gear connected to the frame through a torque limiter and slip clutch for rotatably supporting the frame. Wires are fed through the tube without being subjected to rubbing or twisting. In a closed position of the frame, the light is concealed within the ceiling structure and the decorative panel is flush with the ceiling. In an open position, the light is deployable as it faces into the birthing room. Rotation of the frame between the two positions is powered by a motor, through the reducer gear and torque limiter. On the fixed housing there is one limit switch engageable by a tab on the frame to detect when the frame is proximate the open position, and another switch and tab pair detects proximity to the closed position. In response to detection, the motor turns off.

19 Claims, 15 Drawing Sheets

54
56
58
60
60a
62
62a
64
64a
66
68
70
70a
70b
72

88
18b
706
88a
86a
104
J4
86
S2
T2
T1
J3
168
93
98
90
83a
8
8
99
83
97
18
85
S1
J2
J1
102
80
87a
70a
87
14

CONCEALABLE BIRTHING ROOM LIGHT

BACKGROUND OF THE INVENTION

The present invention relates to a birthing room or surgical light that is concealable, and more particularly, to a light supported on a rotatable frame for deploying or concealing the light as desired.

Hospitals now routinely use a room with a home-like setting for delivery of a newborn baby to provide a natural and reassuring setting for the expectant mother. Hospitals can thus use one room for labor, delivery and subsequent recovery (LDR).

As surgical and obstetrical procedures require high intensity lighting, a surgical quality light must be used in LDR rooms. Such lights are typically large and obtrusive, and thus reduce the natural and reassuring atmosphere of a LDR room. To maintain the desired atmosphere, a concealable surgical light is desired. One such light is disclosed in U.S. Pat. No. 4,651,258 to Davis et al. This light is mounted in the ceiling structure and concealed by two panels. One panel is hinged to the ceiling structure and the other panel is hinged to the one panel. With this hinged structure, ceiling panels hang down into the LDR room and the ceiling and light supporting structure are exposed during deployment of the light.

SUMMARY OF THE INVENTION

The invention is a concealable surgical light device such as for a birthing room. In a preferred embodiment, the device has a rectangular open box-shaped frame for supporting the surgical light on one side and a decorative panel on the other side. The frame, which is itself inventive in its lightweight structure, includes reinforcing ribs positioned in a Y shape and a cylindrical section positioned at the intersection of the ribs for attaching the light. The frame is rotatably supported inside a housing which is fixed within the ceiling structure. At one end of the housing there is a fixed tube forming a wire conduit and having a bearing around it for supporting the frame. At the other end of the housing there is an output shaft of a speed reducer gear connected to the frame through a torque limiter and slip clutch.

In a first position of the frame, the light is concealed within the ceiling structure and the decorative panel is flush with the ceiling. In a second position, the light is deployable as it faces into the birthing room. Rotation of the frame between the two positions is powered by a motor acting through the speed reducer gear, and torque limiter and slip clutch.

DETAILED DESCRIPTION OF THE PREFERRED EMBODIMENT

The invention is a device for concealing a surgical light. The device includes a frame that supports the light and is rotatable between a closed or storage position where the light is concealed in a ceiling or other structure, and an open position where the light is ready for use. The light is supported on the frame which is rotatably supported in a fixed outer housing that mounts to the ceiling.

Figure 1:
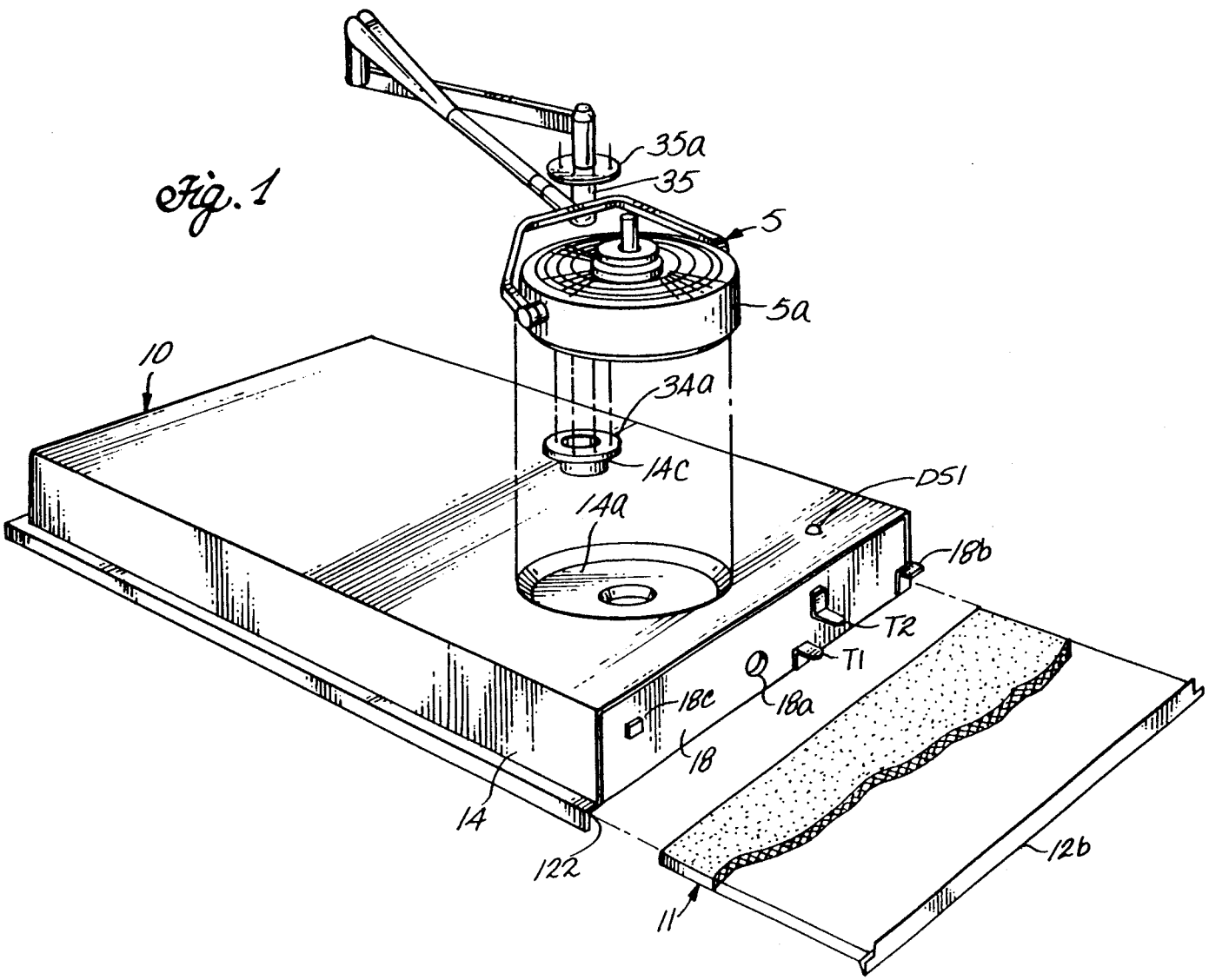
FIG. 1 is a perspective view of a rotatable frame including its cover for supporting a surgical light and a ceiling panel in a device for concealing a birthing room light according to the invention.

FIG. 1 is a perspective view of a standard surgical light 5, e.g., ALM Surgical Equipment Inc.'s ECL line includes several retractable lights such as ECL 152, and a rotatable frame 10 according to the invention. The frame supports the light on one side and a decorative panel 11 such as a ceiling or wall panel on the other side. Frame 10 has a bottom panel 12 with a channel **12*a* to slidably receive ceiling panel 11. An end cover 12*b* welds or otherwise attaches to bottom panel 12 to hold ceiling panel 11 in place. Frame 10 has a U-shaped cover 14 suitably fastened (e.g., removably attached) to the top of bottom panel 12. Cover 14 has a tapered or curved cradle 14*a* for receiving the lamp head 5*a*. Cradle 14*a* has a central aperture 14*b* for receiving a plug fastened to lamp head 5*a*, which plug is retained by a mechanism housed in the rotatable frame, as described below in connection with FIGS. 12 through 14**.

Figure 2:
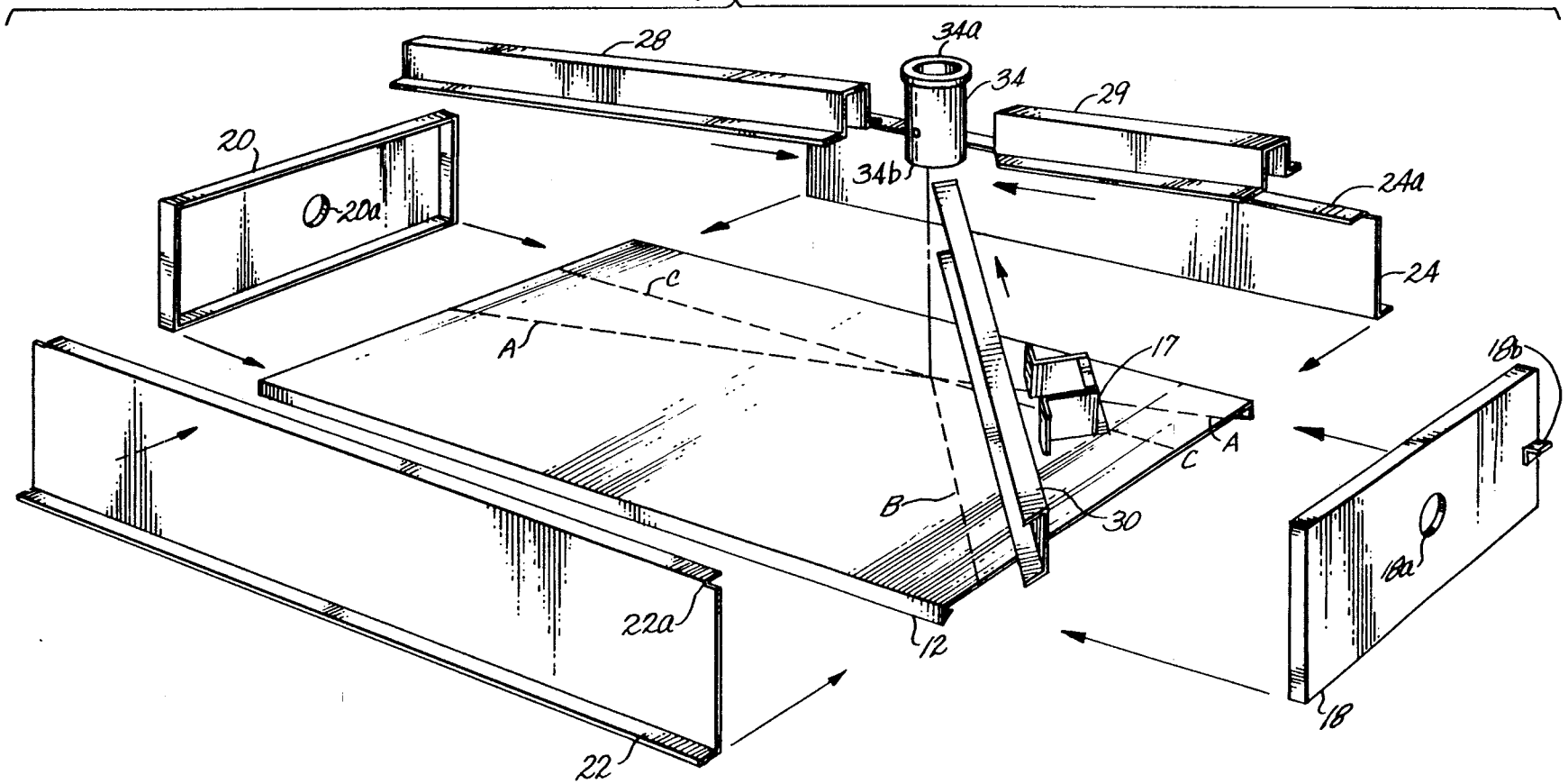
FIG. 2 is an exploded perspective view of the frame of FIG. 1 without the cover.

FIG. 2 is an exploded perspective view of frame 10 without cover 14. Frame 10 has two end panels 18, 20 and two side panels 22, 24. To provide frame 10 with sufficient rigidity for supporting lamp 5 during storage, rotation of the frame and lamp, and deployment of the lamp, there are three reinforcing ribs 28, 29 and 30. A cylindrical section 34 for attaching the lamp is positioned at the intersection of the ribs. Ribs 28 and 29 are preferably hat sections and aligned along a line A, while rib 30 is preferably a U section and aligned along a line B to form a Y shape. Line A is at 10° to a line C parallel to the side edges of bottom plate 12, and line B is at 43¼° to line C. Other suitable cross-sectional shapes and angular alignments of the ribs will be evident to those of ordinary skill in the art. The ribs, panels and cylindrical section are preferably aluminum or aluminum alloy and are welded or otherwise attached to bottom panel 12 and to each other as appropriate.

With renewed reference to FIG. 1, cover 14 has a substantially cylindrical tapered section 14c for receiving and supporting cylindrical section 34 with a flange 34a. Light 5 has a cylindrical lamp mounting assembly 35 which fits inside cylindrical section 34. Assembly 35 has a flange 35a at which the light is screwed or bolted to flange 34a of section 34. During storage and during rotation of the light and frame assembly, lamp head 5a fits in cradle 14a where it is held in place by a retaining mechanism housed in a mounting box 42 bolted or welded to rib 30 and bottom plate 12. Cradle 14a, hole 14b and cylindrical tapered section 14c are preferably vacuum formed.

Figure 3:
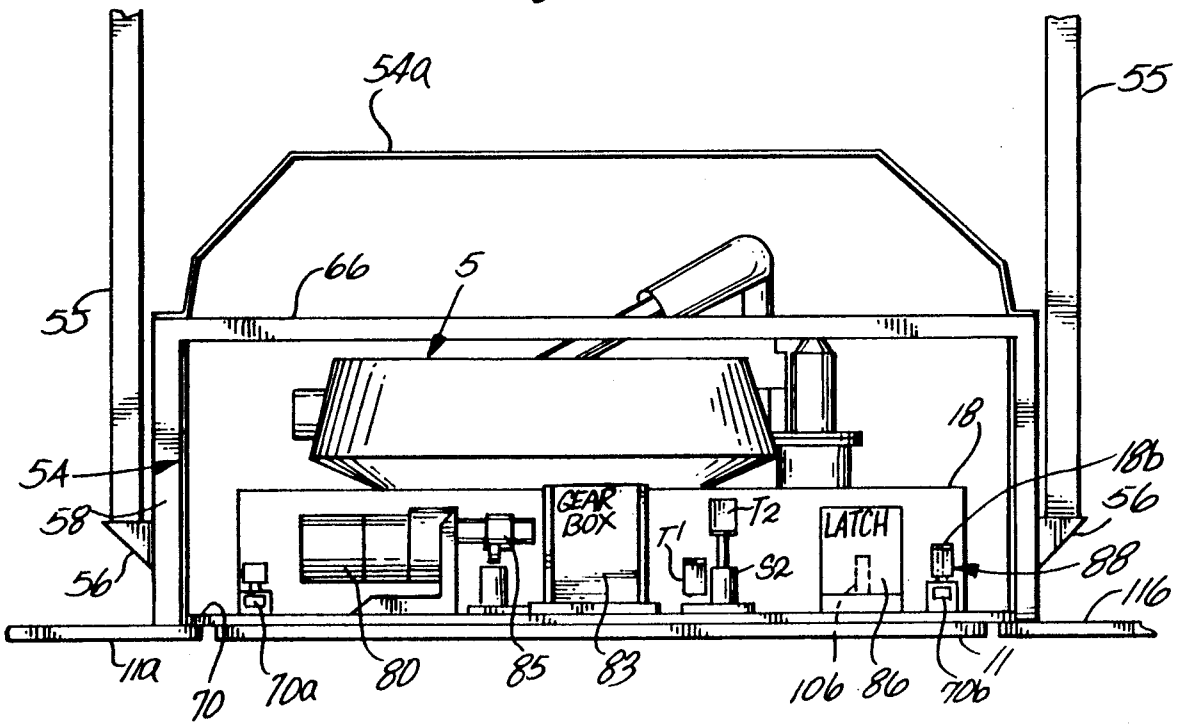
FIGS. 3–5 are partially schematic, side views of the inventive device mounted in a ceiling and showing the frame and light of FIG. at a concealed position, a partly open position and a fully open (deployable) position, respectively.
Figure 4:
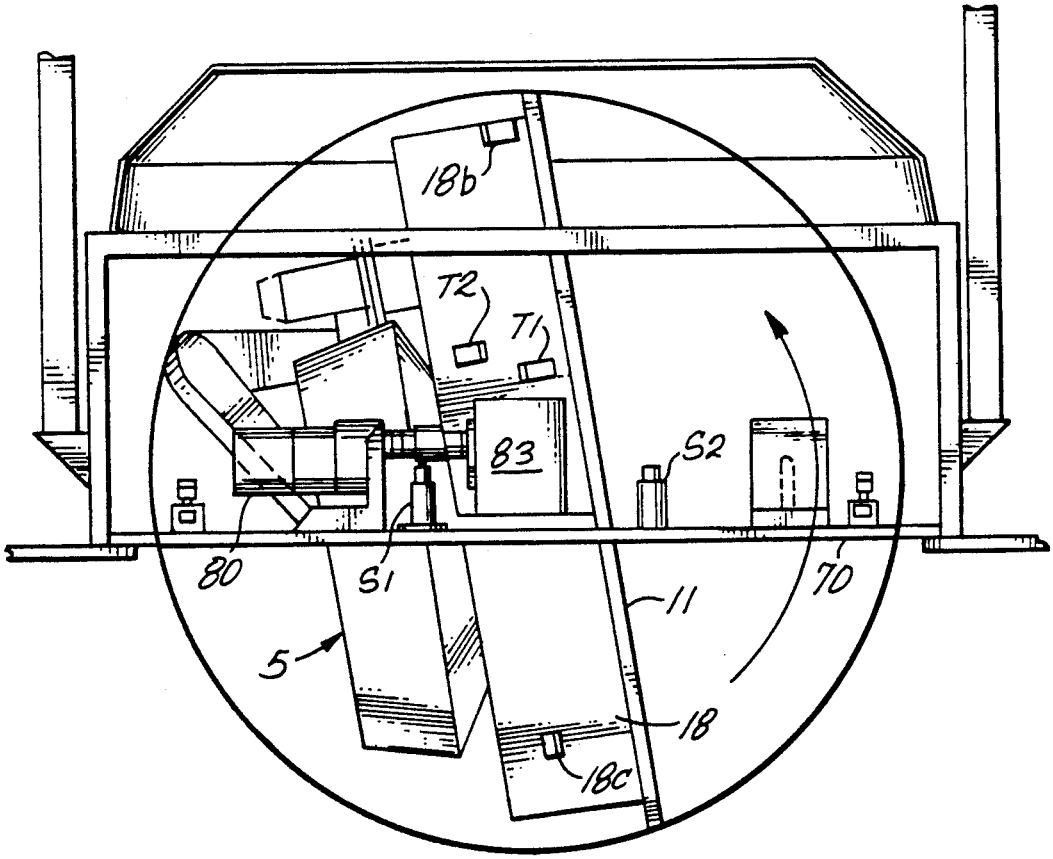
Figure 5:
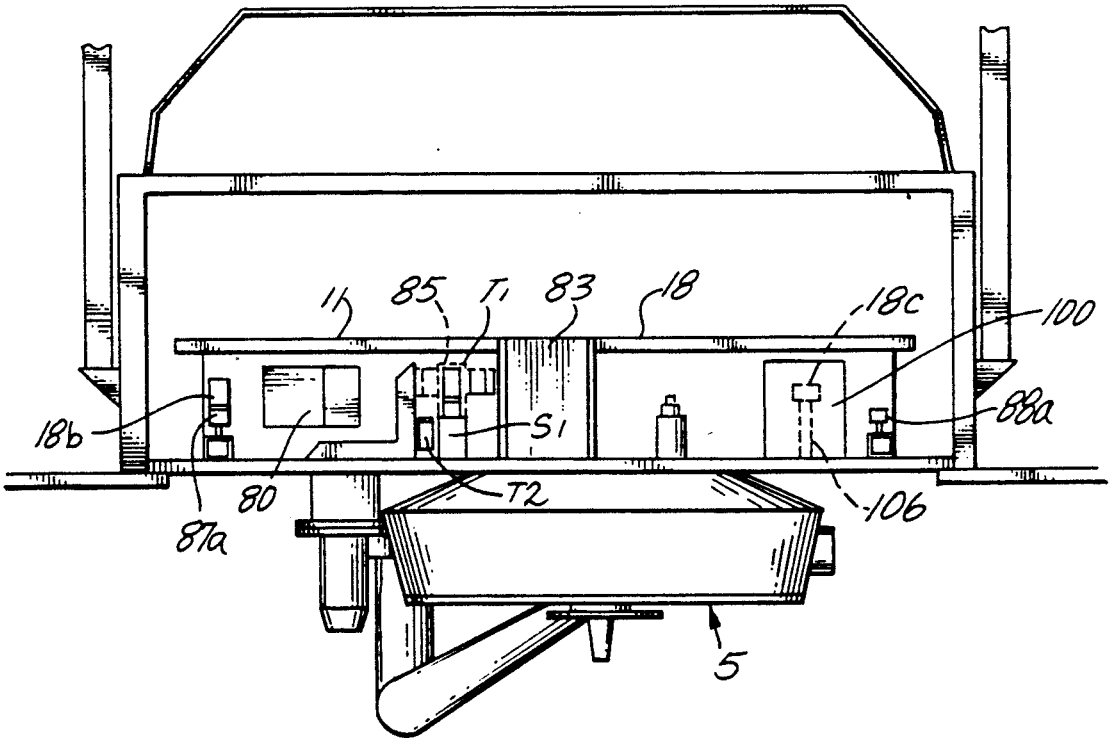
Figure 6:
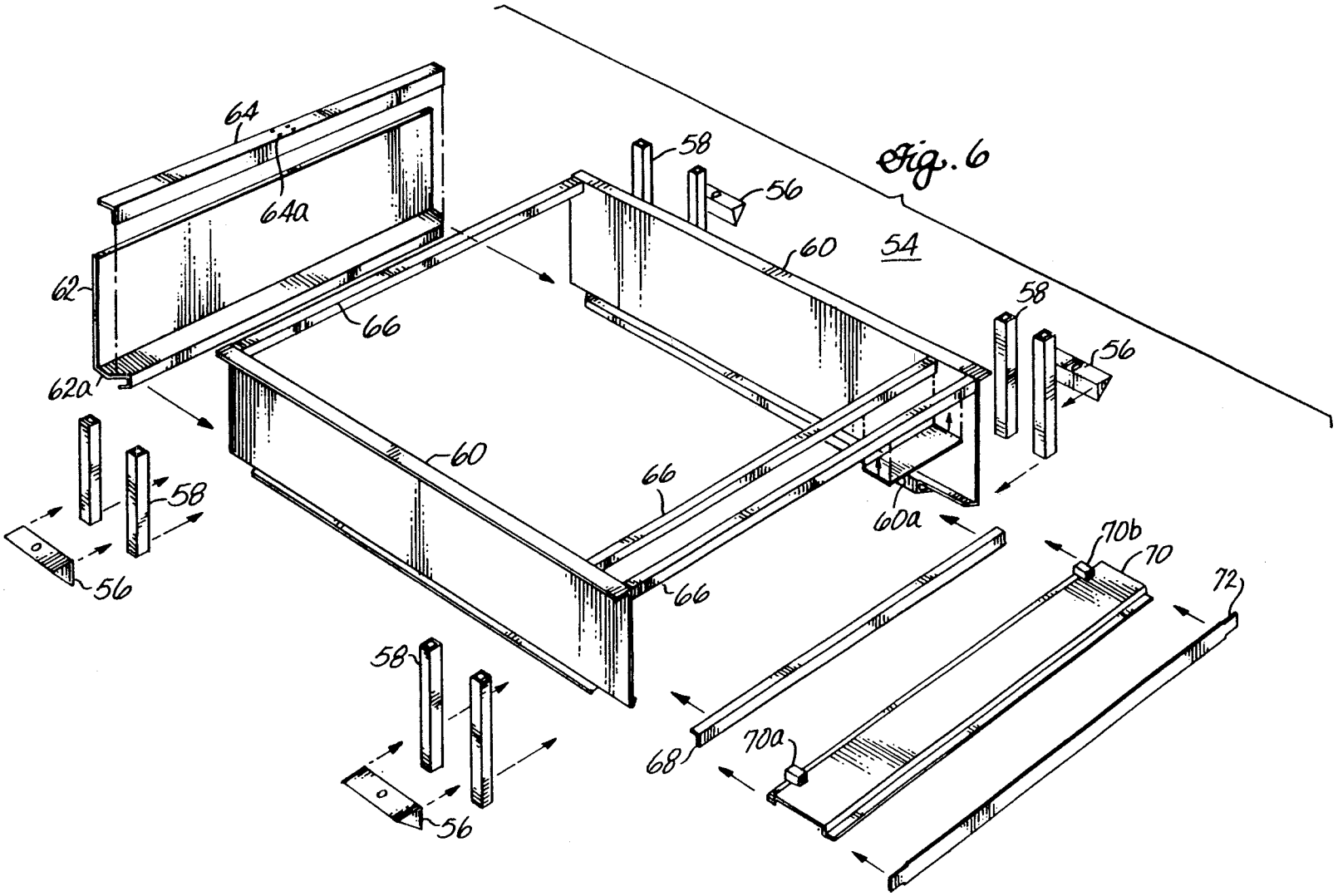
FIG. 6 is an exploded perspective view of an outer housing for rotatably supporting the frame of FIG. 1.

FIGS. 3–5 show rotatable frame 10 within an outer housing 54 fixed to portions of a building such as girders 55 in the ceiling, the frame being at closed, partly open, and fully open (deployed) positions, respectively. FIG. 6 is an exploded view of an outer housing 54, which has four mounting brackets 56 for attaching the housing to girders 55. Each bracket 56 attaches to a pair of columns 58 (e.g., square tubing) in turn mounted at respective edges of two side panels 60. Frame 54 has a rear panel 62 with a flange 62a for fixing a vertical leg of an angle 64. The horizontal leg of angle 64 is fixed to the vertical face of panel 62. Three cross beams 66 support side panels 60. A junction box mounting plate 60a attaches to the underside of two of the beams 66. An angle 68, a component mounting plate 70 having two pieces 70a and 70b of square tubing mounted on it and an end cover 72 are fixed to the side panels 60. The outer frame is preferably steel and is welded or otherwise fixed together. The outer frame has a dust cover 54a of a thin aluminum. Its shape need only fit in the ceiling structure and provide clearance for rotation of frame 10 and light 5. Cover 54a is preferably formed in three pieces, one large piece covering the top of the outer housing except for the two closely spaced cross beams 66 above plate 70, one smaller piece (not shown) for covering the two beams 66 above plate 70, and another smaller piece (not shown) for covering the end of the housing along plate 70. These two smaller pieces are removably attached to provide access to the components supported on plate 70.

Figure 7:
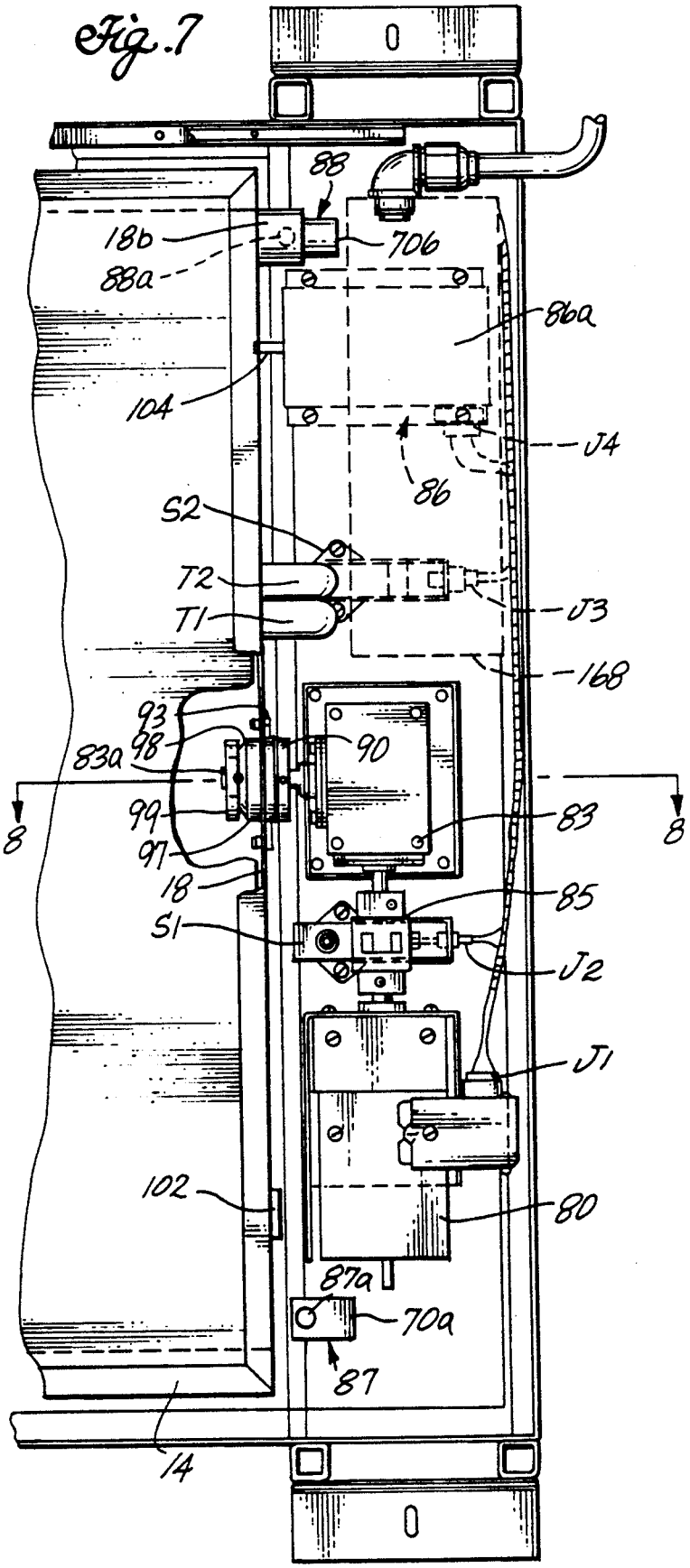
FIG. 7 is a top view of portions of the frame of FIG. 1 and outer housing of FIG. 6 and major components of the device for initiating and controlling rotation of the frame, the frame being shown in the closed position.

The components supported on plate 70 are shown from the side in FIGS. 3–5 and from the top in FIG. 7. The components include a drive mechanism formed by a motor 80 (e.g., 63 rpm), gear box 83, coupling halves 85 for coupling the motor's output shaft and an input shaft to a worm reducer gear (such as a Boston gear) in gear box 83, and a torque limiting connection (described below with reference to FIG. 8) between an output shaft of the reducer gear and frame 10. Plate 70 also supports two limit switches S1, S2 for detecting substantial completion of rotation of frame 10, a latch mechanism 86 in a housing 86a, and two bumpers 87, 88. The bumpers 87, 88 are neoprene or urethane pads 87a, 88a with a steel core fixed on the square tubing 70a, 70b, respectively. The bumpers alternately cooperate with a tab 18b (e.g., an angle) integrally formed on panel 18 preferably in the plane of the axis of rotation of the frame 10 along with the tops of the bumpers. Switches S1 and S2 are alternately engageable by tabs T1, T2 (e.g., angles) fixed on panel 18. In FIG. 7, frame 10 is in the closed position in which tab 18b rests on bumper 88, and tab T2 contacts switch S2. Gear box 83 contains the worm gear or speed reducer (e.g., 50 to 1) of a type well known in the art.

Figure 8:
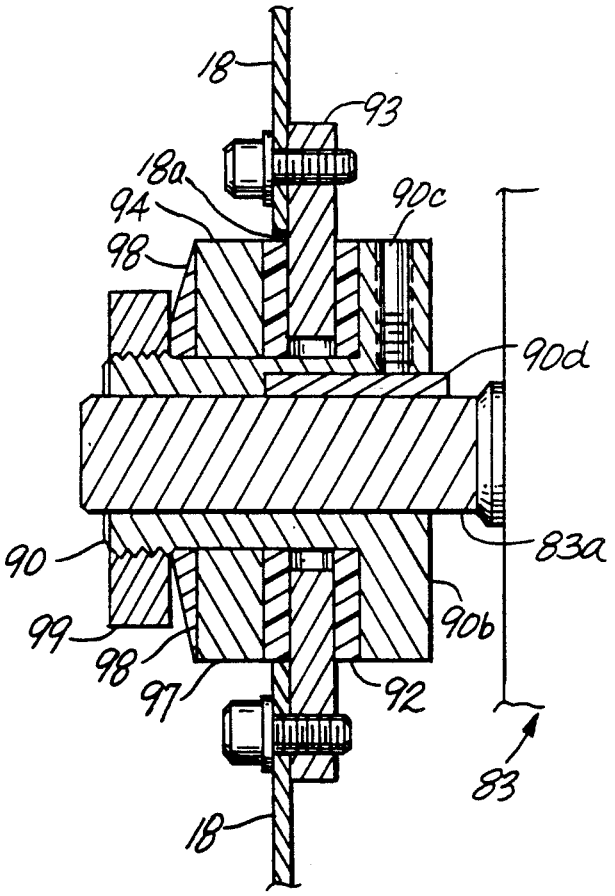
FIG. 8 is an enlarged sectional view taken along a line 8—8 of FIG. 7 showing a torque limiting connection between an output shaft of a speed reducer gear and a panel of the frame of FIG. 1.

FIG. 8 is an enlarged sectional view, taken along line 8—8 in FIG. 7, of the torque limiting connection between output shaft 83a of the reducer gear and end panel 18 of frame 10. Shaft 83a fits through a hole 18a in panel 18 and has a cylindrical flange 90 having a threaded end 90a. Flange 90 has an enlarged portion 90b where it is fixed on shaft 83a by means of a 3/16 square key supply 90c and plate 90d. Flange 90 slidably receives a fiber disc or clutch fiber 92, a friction disc 93 (e.g., ¼" thick and having slightly roughened surfaces with a slight clearance), another fiber disc 94, a plate 97, a tapered washer-type spring 98 (e.g., a Belleville spring), and a nut 99 threaded onto the flange. Friction disc 93 bolts to end panel 18 to transmit torque to the rotatable frame. The desired tightness of nut 99 is normally best found by trial and error, as it will depend largely upon the motor overrun. The torque limiting connection thus also functions as a slip clutch for when tab 18b contacts one of the bumpers 87, 88 to complete rotation of the frame.

Figure 9:
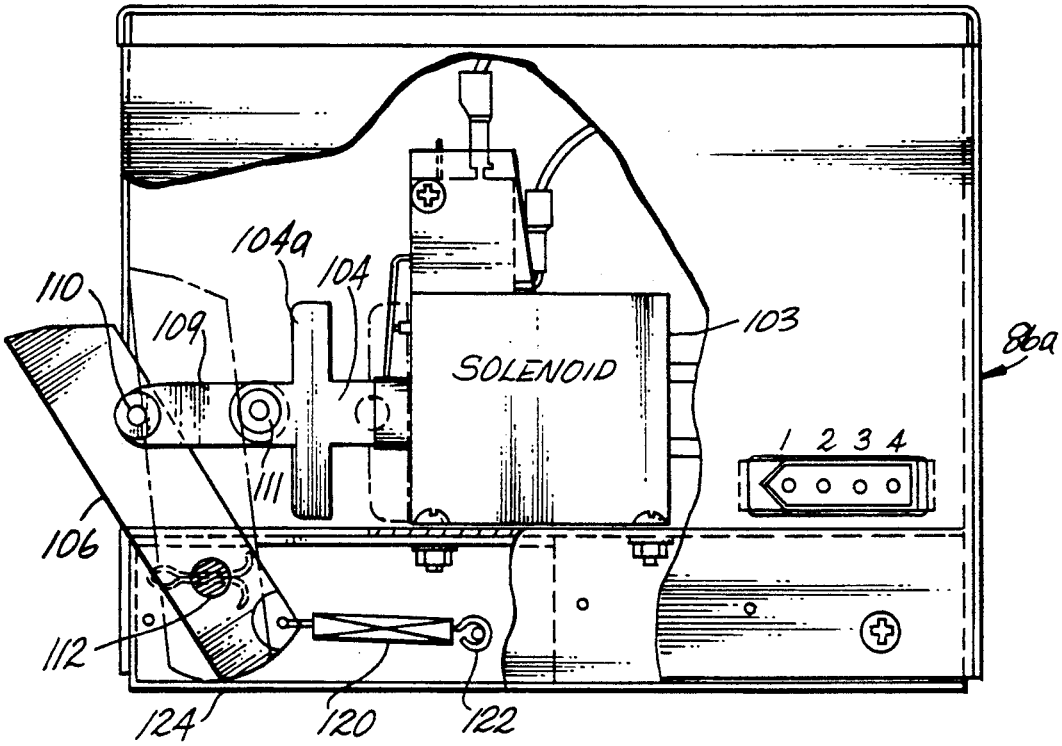
FIG. 9 is a partially schematic and partially cutaway side view of a latching assembly for latching the frame of FIG. 1 in the deployed position of FIG. 5.
Figure 10:
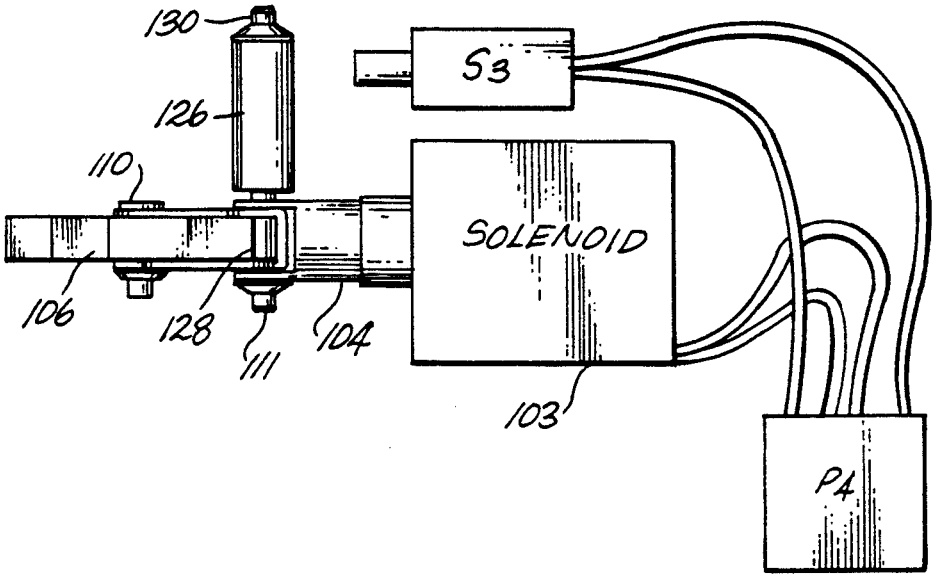
FIG. 10 is a partially schematic top view of the latching assembly of FIG. 9.

As shown in FIGS. 9 and 10, which are side and top views of the interior of latch mechanism 86, the latch mechanism is formed by a solenoid 103 having a T-shaped arm 104 attached to a tilted bar 106 by means of a linkage extension 109. The extension 109 attaches to the bar at rivet 110 and to arm 104 at nut 111. Bar 106 rotates on a pin 112 fixed to housing 86a. A tension spring 120 is fixed to housing 86a by a hook and eye arrangement at one end 122 and to bar 106 at another end 124 to bias bar 106 counterclockwise and in turn bias arm 104 to its extended position shown in solid lines in FIG. 9. When light 5 is in the deployable position, bar 106 engages a projection 18c (e.g., a steel plate) fixed on panel 18 to prevent rotation of the frame, as shown in FIGS. 1 and 5. A limit switch S3 mounts on housing 86a adjacent solenoid 103 and is engageable by an actuating rod 126 (e.g., of plastic) fixed to arm 104 on a pin 128 by nut 111 and another nut 130, as shown in phantom in FIG. 9.

Figure 11:
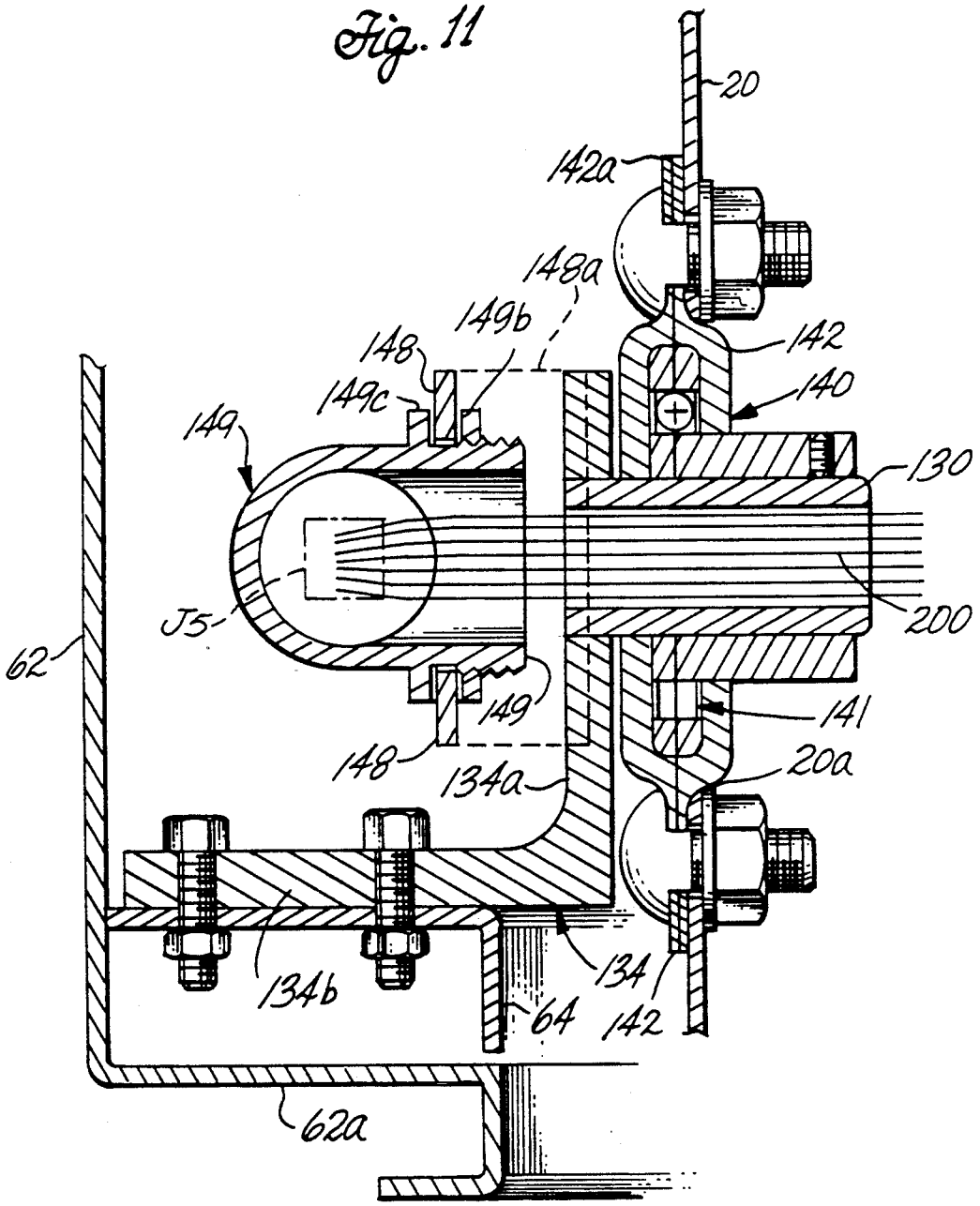
FIG. 11 is a vertical sectional view of a tube and bearing assembly for mounting the frame of FIG. 1 to the outer housing of FIG. 6 at an end opposite the torque limiting connection of FIG. 8.

FIG. 11 is an enlarged partial sectional view of a bearing and tube assembly for supporting rotatable frame 10 and for enabling wiring to enter frame 10 without being subject to the affects of rotation of the frame. A tube 130 passes through, and is welded to, an angle 134 at its vertical leg 134a. Its horizontal leg 134b bolts through holes 64a (FIG. 6) to the horizontal leg of angle 64 of outer housing 54. Thus, the tube is fixed. A self-aligning flange ball bearing assembly 140 fits around tube 130, and in hole 20a of panel 20. The assembly 140 includes a ball bearing 141 in a two-piece housing 142 with a thin shim (not shown) between the housing halves. The housing has an annular flange 142a at which the assembly bolts to end panel 20 so that the assembly is in hole 20a. A suitable ball bearing assembly is well known.

A U-shaped section 148 (e.g., 1/16" steel plate) is welded at its arms 148a to the sides of vertical leg 134a of angle 134 to provide a mounting surface for a 90° conduit fitting 149. Section 148 has an aperture aligned with tube 130. The fitting 149 has an externally threaded end 149a which fits through the aperture. A nut 149b fastens fitting 149 in place with a hexagonal portion 149c and a washer abutting the section 148. The fitting 149 bends seven wires 200 by 90° to connect with a connector J5 (shown as a phantom box). The connector is mounted on a bracket (not shown).

Figure 12:
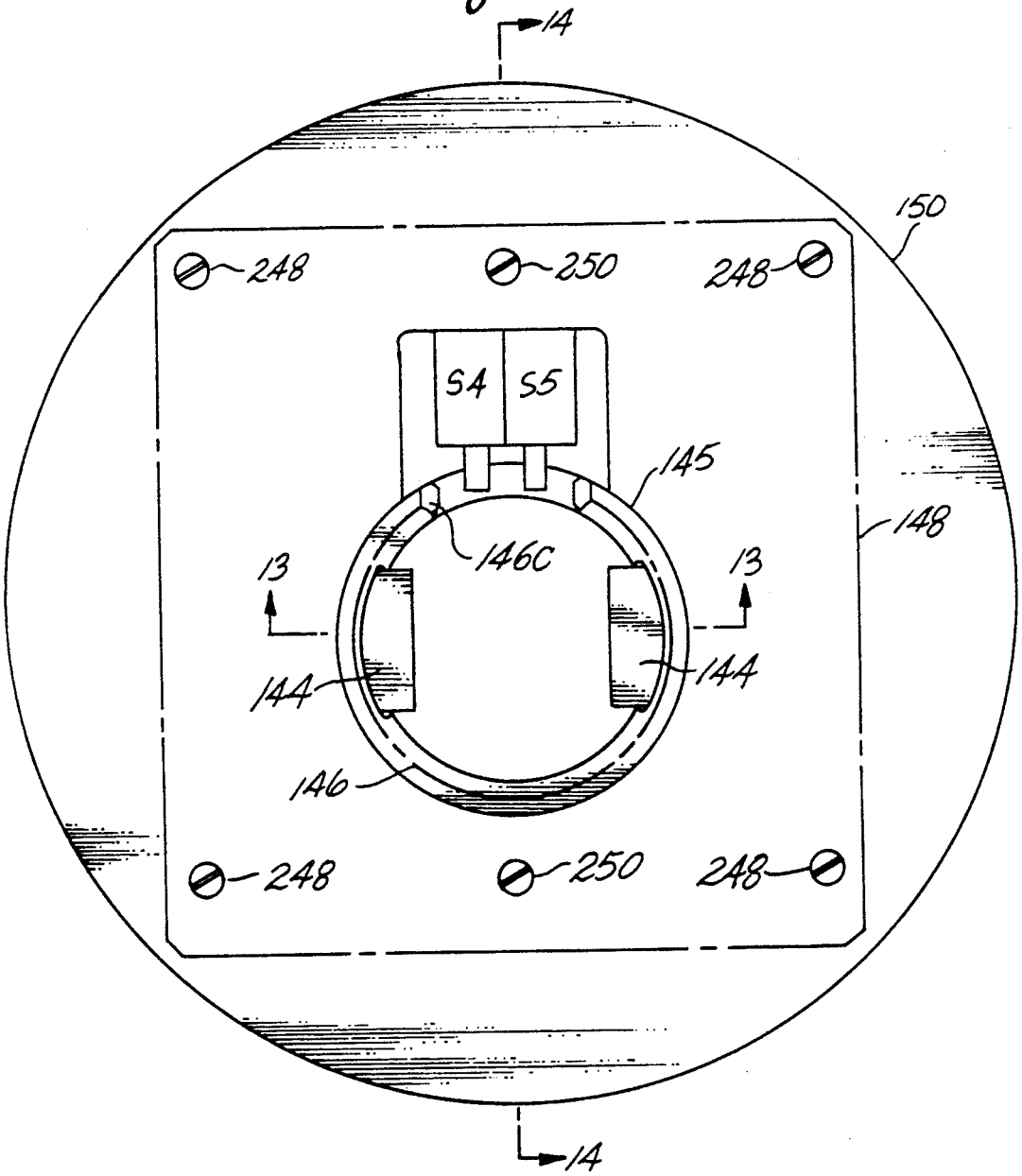
FIG. 12 is a top view of a retainer assembly for releasably retaining and detecting the light in its retracted position.
Figure 13:
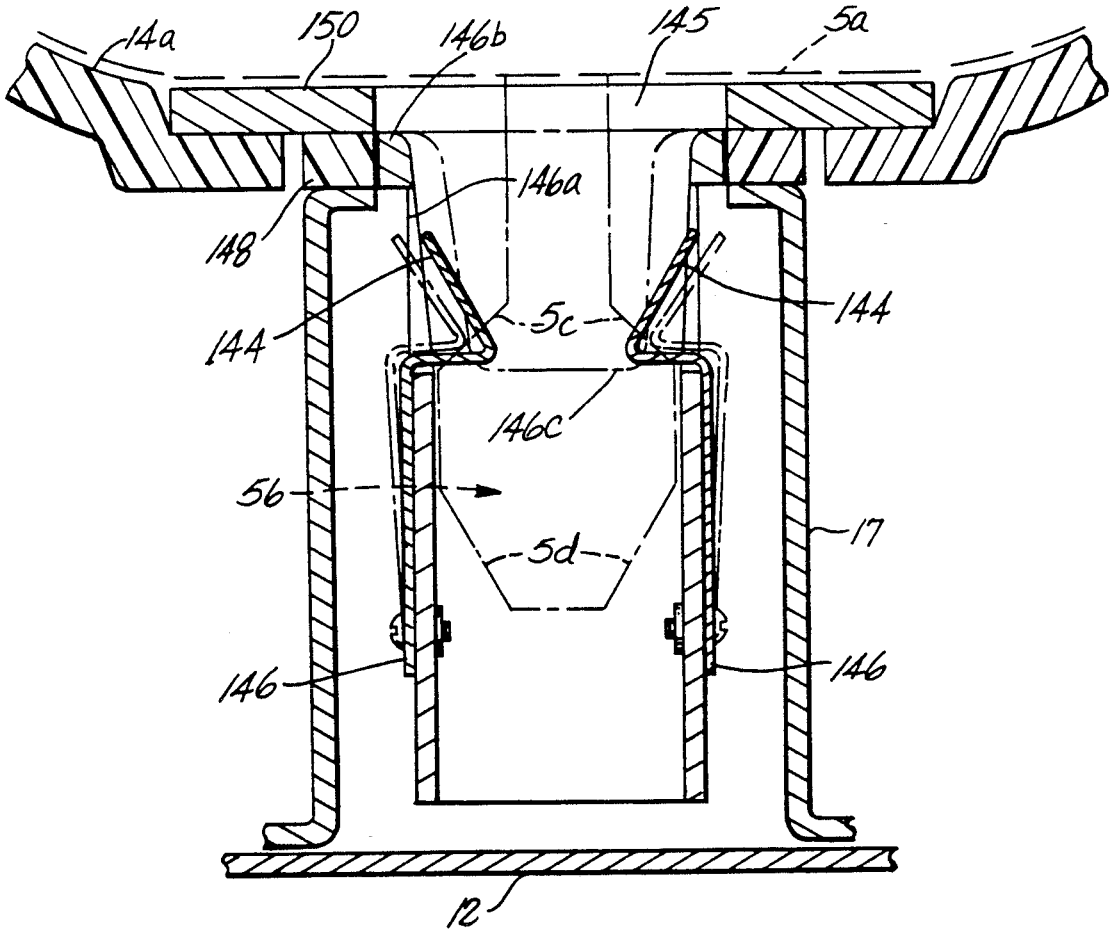
FIG. 13 is a vertical sectional view of the retainer assembly taken along line 13—13 of FIG. 12.

The mechanism for retaining lamp head 5a in place until deployed and for detecting retention of the lamp head is shown in FIGS. 12 through 15, which are a top view of the mechanism, a vertical sectional view of the mechanism taken along a line 13—13 of FIG. 12, a vertical sectional view taken along a line 14—14 of FIG. 12, and a top view of a portion of the lamp head which engages the mechanism, respectively. The mechanism is housed in box 17 (see FIG. 2 also) and includes a pair of spring clips 144 fastened to a substantially cylindrical tube 146 by means of two screws (FIGS. 12 and 13).

It should be noted that the plane of FIG. 13 is parallel to rib 30 of FIG. 2, with the switches S4, S5 positioned remote from the rib. The clips 144 fit into cutout sections 146a of the tube to engage the plug 5b (e.g., of PVC) attached to lamp head 5a, as described below. The plug enters tube 146 through the circular portion of a keyhole 145. The plug has 45° surfaces 5c and 30° surfaces 5d joined by flat surfaces. The 30° surfaces cam the clips 144 outward to allow the plug to enter tube 146, then clips 144 engage the 45° surfaces to retain the plug as shown in phantom in FIG. 13.

The cylindrical tube 146 is welded at its upper lip 146b to a top rectangular or square flange or plate 148. The plate 148 fastens at its four corners to a flange on box 17 by screws 248 (FIG. 12). On top of plate 148 is a circular plate 150 which keeps the center hole of cradle 14a in place and aligns keyhole 145 with aperture 14b. The circular plate 150 is fastened to plate 148 by screws 250, such that the keyhole 145 in each plate is aligned.

Figure 14:
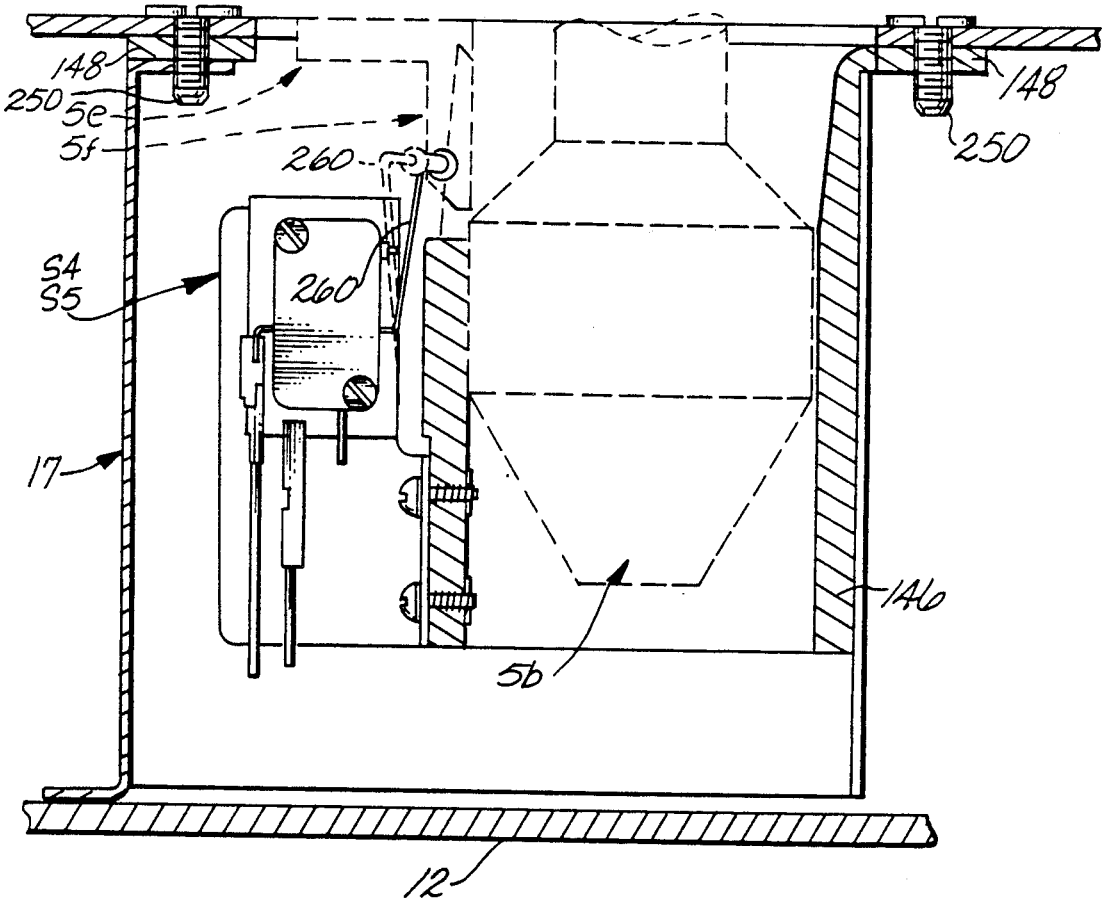
FIG. 14 is a vertical sectional view of the retainer assembly taken along line 14—14 of FIG. 12.
Figure 15:
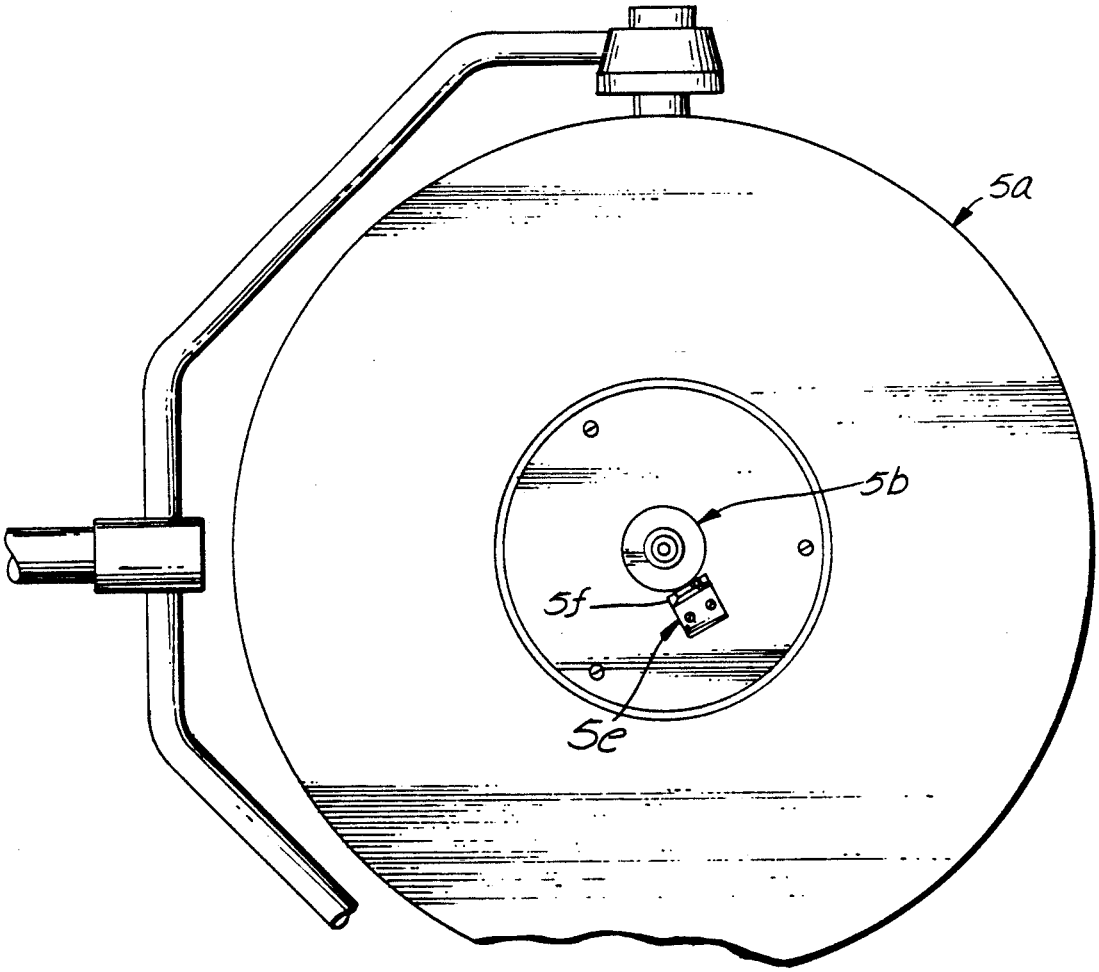
FIG. 15 is a top view of a portion of the light adapted for being retained and detected by the assembly of FIG. 12.

The lamp head 5a has plug 5b and an angle-shaped actuator 5e bolted to it (FIG. 15). Circular plate 150 has the key-shaped hole 145 defined in it as well as plate 148. The actuator 5e fits through the rectangular portion of the keyhole. Two limit switches S4, S5 mount directly below the rectangular portion of key hole 145 so that their detectors 260 will be engaged by a vertical leg 5f of actuator 5e when plug 5b is fully retained by clips 144 (FIG. 14). Cylindrical tube 146 has a cutaway section 146c (shown in phantom in FIG. 13) at which switches S4, S5 meet actuator 5e.

Figure 16:
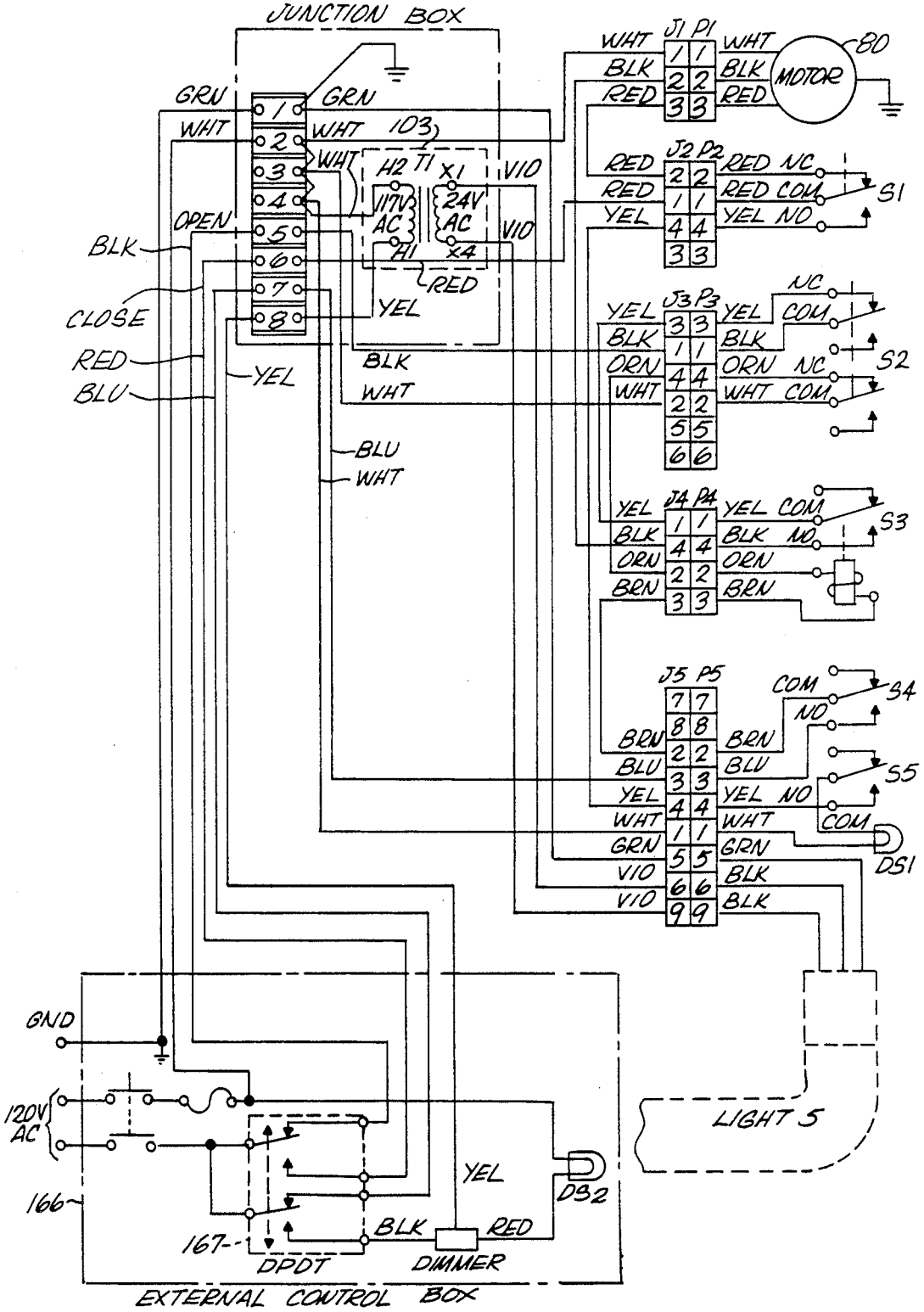
FIG. 16 is a detailed circuit diagram for the inventive device.

FIG. 16 is a detailed circuit diagram of the inventive device showing an external control box 166 connected to a 120 V power source and ground and having a double pole double throw (DPDT) switch 167 for connecting the power source with the motor, limit switches, two indicator lights DS1 and DS2, the solenoid, and the surgical light. To assist in connecting the power source to these electrical devices, there is a junction box 168, which is mounted above the latch mechanism 86 to the underside of plate 60a (see FIGS. 6 and 7). Receptacles J1 and connectors P1 link wires from junction box 168 and solenoid 103 with motor 80, switches S1, S2, S3 and all of S4, S5, DS1 and light 5 (®.g., through hole 34b in cylindrical section 34 of FIG. 2), respectively.

With reference primarily to FIGS. 3-5 and FIG. 15, operation of the retractable light will now be explained. Initially, light 5 is in the concealed position in which ceiling panel 11 in rotatable frame 10 faces downward and is flush with other ceiling panels 11a, 11b. In this position, the light and frame assembly is not only supported by reducer gear output shaft 83a and tube 130, but also by tab 18b resting on bumper 88 and to some extent by tab T2 resting on switch S2. In addition, arm 104 of solenoid 103 extends so that bar 106 touches or almost touches frame 10 at panel 18 but does not present any substantial resistance to rotation of frame 10. The weight of light 5 and frame 10 (due mostly to light 5, ribs 28, 29, 30, and cylinder 34) is mainly on the side of the axis of rotation of the frame on which bumper 88 lies. Accordingly, there is no tendency for the frame to open, and bumper 88 supports much of the weight.

To start the frame and light rotating, one throws DPDT switch 167 on the external control panel 166, motor 80 starts turning to turn shaft 83b, and thus frame 10, as shown in FIG. 4. Now only shaft 83b and tube 130 support frame 10 and light 5. Just prior to completion of turning, tab T1 hits switch S1, turning off motor 80. Turning continues as a result of motor overrun. Proximate the point at which tab T1 hits switch S1, projection 18c on panel 18 cams bar 106 of latch mechanism 86 inward against the bias of spring 120 so that projection 18c slides by the bar. In FIG. 5, T1 is shown in solid lines while coupling halves 85 are shown in phantom for emphasis even though T1 and S1 are positioned closer to panel is than coupling halves 85.

Rotation ends when tab 18b contacts bumper 87. As noted above, the slip clutch function of the torque limiting connection takes out any remaining motor overrun. At this point, projection 18c will have slid by bar 106 which will have returned to its extended position due to spring 120, thus locking the frame and light in the deployed position. In addition, the weight of the frame and light are now supported mostly by bumper 87, and also by shaft 83b, tube 130, and to some extent switch S1.

In the deployed position, the light is removable from box 17 and oriented as desired with ribs 28, 29, 30 and cylindrical section 34 providing the necessary rigidity and support. Cover 14 of frame 10 hangs below ceiling level, but has a finished appearance. The user now may pull the light down so that plug 5b and actuator 5e come out of box 17, and may position the light as desired. If the on/off switch (which preferably includes a dimmer) on the control panel is on, indicator light DS2 goes on.

To restore the light and frame to the concealed position, plug 5b and actuator 5e must first be inserted into box 17. This actuates switches S4, S5 which turn on DS1 to indicate that the light and frame are ready for storage. The user throws DPDT switch 167. First, solenoid arm 104 and thus bar 106 retract unlocking the frame and actuating switch S3 through rod 126. Switch S3 completes the circuit between the power source and motor 80 thus initiating rotation of frame 10 and light 5. When the frame has almost fully rotated 180°, tab T2 contacts switch S2 turning off motor 80 and releasing solenoid arm 104. Tab 18b then contacts bumper 88, as a result of motor overrun.

As a fail safe measure, the torque-limiting connection allows the frame to be manually rotated from the concealed to deployed position by pulling down on the side of the frame opposite tab 18b (or pushing on the tab 18b side). The frame may be restored to the concealed position by pushing on the tab 18b side or pulling on the other side, as long as the latch mechanism is working. Otherwise, the latch must be manually overcome.

The invention is not limited to the described embodiment, as the claims define the invention and as numerous other embodiments falling within the scope of the claims will be evident to those of ordinary skill in the art.

What is claimed is:

1. A lighting device concealable in a structure, the device comprising:

(a) a frame having first and second sides and means for mounting a light on the first side thereof;

(b) means fixedly attachable to the structure for supporting the frame for rotation between a closed position in which the second side of the frame is exposed and the light is concealed, and an open position in which the first side of the frame is exposed and the second side is concealed; and (c) drive means for rotating the frame between the closed and open positions.

2. The device of claim 1 wherein the first and second sides are opposite each other and the frame rotates 180°.

3. The device of claim 1 wherein the second side of the frame supports a decorative panel.

4. The device of claim 1 wherein, when the frame is in the open position, the light is movable between a retracted position with respect to the frame and a least one extended position with respect to the frame, and the device further comprises a receptacle for releasably holding the light in the retracted position, and means for preventing actuation of the drive means unless the light is in the retracted position.

5. The device of claim 1 wherein the supporting means comprises a substantially rectangular box with one open side, reinforcing ribs disposed substantially in a Y shape, and means for attaching the light positioned at the intersection of the ribs.

6. The device of claim 1 wherein the light has a plug attached to it, and the frame further comprises means for releasably receiving and holding the plug.

7. The device of claim I wherein the drive means comprises: a motor having an output shaft; a speed reducer gear having an input shaft connected to the output shaft of the motor, the speed reducer having an output shaft; and a torque limiter mounted on the output shaft of the speed reducer gear and connected to the frame.

8. The device of claim 1 further comprising means for detecting substantial completion of rotation of the frame from the closed to the open position and from the open to the closed position, and for deactivating the drive means to stop rotation of the frame in response to the detection of substantial completion.

9. The device of claim 1 further comprising means for latching and unlatching the frame in the open position.

10. The device of claim 9 further comprising means for actuating the unlatching means, and for actuating the drive means when the frame is unlatched from the open position.

11. The device of claim 10 wherein the means for latching and unlatching comprises a solenoid having a normally extended arm.

12. The device of claim 1 further comprising means for electrically connecting the light and a power source, wherein the supporting means includes a tube through which the means for electrically connecting passes, and further includes a bearing for supporting the frame on the tube.

13. The device of claim 1 further comprising first means for stopping the frame from rotating when it reaches the closed position, and second means for stopping the frame from rotating when it reaches the open position.

14. The device of claim 13 wherein the drive means is subject to overrun and further comprises means for accommodating the overrun.

15. A concealable surgical light device for installation in a structure having an exterior surface defining a room, the device comprising:

(a) a frame having a first side including means for mounting a surgical light and a second side matching the exterior surface of the structure;

(b ) a housing fixedly installed in the structure for supporting the frame for rotation with respect to the housing between a closed position in which the second side of the frame is flush with the exterior surface of the structure and the light is concealed, and an open position in which the second side is within the structure and the first side is exposed such that the light faces into the room;

(c) drive means for rotating the frame between the closed and open positions, wherein the frame is supported on the housing by a bearing at one end of the frame, the drive means comprising a torque limiter supporting the frame at a second end opposite the one end, the torque limiter and bearing defining an axis of rotation of the frame, the light being mounted on the frame on one side of the axis of rotation;

(d) first means mounted on the housing on the one side for stopping the frame from rotating upon reaching the closed position and for supporting the frame in the closed position, and second means mounted on the housing on a side opposite the one side for stopping the frame from rotating upon reaching the open position and for supporting the frame in the open position; and (e) means for detecting substantial completion of rotation of the frame from the closed to the open position and from the open to the closed position, and for deactivating the drive means to stop rotation of the frame in response to the detection of substantial completion.

16. The device of claim 15 further comprising means for latching and unlatching the frame in the open position.

17. A lighting device concealable in a structure comprising:

(a) a frame, having first and second sides, and means for mounting a light on the first side thereof;

(b) means for supporting the frame for rotation with respect to the structure between a closed position in which the second side of the frame is exposed and the light is concealed, and an open position in which the first side of the frame and the light are exposed; and (c) drive means for rotating the frame between the closed and open positions, wherein the frame further comprises means for providing rigidity to the frame comprising three ribs disposed in a Y shape with the means for mounting disposed at the intersection of the ribs.

18. The device of claim 17 wherein two of the three ribs lie along one line and the other of the ribs lies along another line.

19. The device of claim 18 wherein the frame further comprises a substantially flat rectangular base having two side walls and two end walls, and wherein one of the ribs is attached to one of the end walls, and the other two of the ribs are attached to the other of the end walls.

* * * * *

UNITED STATES PATENT AND TRADEMARK OFFICE

CERTIFICATE OF CORRECTION

PATENT NO. : 5,060,124

DATED : October 22, 1991

INVENTOR(S) : George E. Crispin; Burnie M. Craig; Roy K. Fujitaki

It is certified that error appears in the above-identified patent and that said Letters Patent is hereby corrected as shown below:

Column 1, line 62, after "FIG." insert -- 1 --.

Column 5, line 59, change "®.g.," to -- e.g., --.

In the Claims

Column 7, line 21, before "least" change "a" to -- at --.

Column 8, line 10, change "(b ) to -- (b) --.

Signed and Sealed this

Thirtieth Day of March, 1993

*Attest:*

STEPHEN G. KUNIN

*Attesting Officer*

*Acting Commissioner of Patents and Trademarks*